US007079154B2

(12) United States Patent
Martin et al.

(10) Patent No.: US 7,079,154 B2
(45) Date of Patent: Jul. 18, 2006

(54) SUB-PIXEL ASSEMBLY WITH DITHERING

(75) Inventors: Eric Martin, Corvallis, OR (US); William Allen, Corvallis, OR (US); John Da Cunha, Corvallis, OR (US); Andrew Koll, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 433 days.

(21) Appl. No.: 10/346,492

(22) Filed: Jan. 18, 2003

(65) Prior Publication Data

US 2004/0140980 A1 Jul. 22, 2004

(51) Int. Cl.
*G06G 5/02* (2006.01)

(52) U.S. Cl. ..... 345/596; 345/599; 345/613; 345/694

(58) Field of Classification Search ..... 345/596–599, 345/612–614, 690, 694–696, 168, 171 FOR; 358/3.13, 3.16, 3.17, 3.22, 175 FOR
See application file for complete search history.

(56) References Cited

U.S. PATENT DOCUMENTS 5,568,571 A * 10/1996 Willis et al. ..... 382/254
5,818,971 A * 10/1998 Moolenaar et al. ..... 382/252

* cited by examiner

*Primary Examiner*—Kee M. Tung
*Assistant Examiner*—Gregory Cunningham

(57) ABSTRACT

A sub-pixel assembly of one embodiment of the invention is disclosed that includes a number of active display units. Each active display unit is capable of controlling light, and has a turn-on threshold responsive to a signal. The active display units are organized by their turn-on thresholds to achieve dithering of the light, in response to the signal.

6 Claims, 5 Drawing Sheets

SUB-PIXEL ASSEMBLY WITH DITHERING

BACKGROUND

Display devices include projector systems, which are generally devices that integrate light sources, optics systems, and electronics for front- or rear-projection of images from computers or video devices onto walls or screens, for large-image viewing. They are especially popular among business users who give presentations as part of their job responsibilities. Newer projectors can weigh as little as a few pounds, making them well suited for business travelers. As the quality of projection technology has improved, projectors are also finding their way into peoples' homes for high-definition television (HDTV) and other home entertainment applications. Some industry pundits predict that digital projectors will also become the standard projection technology used in movie theaters.

Projector systems usually include a number of display units to provide a given pixel resolution. For instance, there may be one or more such display units for each pixel, depending on the type of the display units and whether a gray-scale or a color projector system is desired, such as three sub-pixels for the colors red, green, and blue. The display units are typically individually addressable, meaning that the projector system internally has to be able to communicate with each display unit on an individual basis. For a projector system having an SVGA resolution (800×600 resolution, or 480,000 pixels) or an XGA resolution (1024×768 resolution, or 786,432 pixels), this can mean that the system may have to individually address large number of display units. Such individual addressing of each display unit can add undue complexity and cost to the resulting projector system.

SUMMARY OF THE INVENTION

A sub-pixel assembly of one embodiment of the invention includes a number of active display units. Each active display unit is capable of controlling light, and has a turn-on threshold responsive to a signal. The active display units are organized by their turn-on thresholds to achieve dithering of the light, in response to the signal.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Active Display Unit

Figure 1:
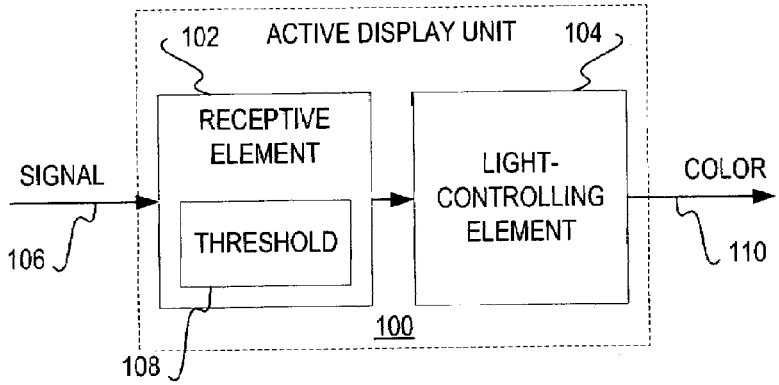
FIG. 1 is a diagram of an active display unit, in conjunction with which embodiments of the invention may be implemented.

FIG. 1 shows an active display unit 100, in conjunction with which embodiments of the invention may be practiced. The active display unit 100 may in one embodiment be the unit particularly described in the previously filed and coassigned patent application entitled "Method and Apparatus for Image and Video Display," having the first named inventor William J. Allen, filed on Dec. 14, 2001, and assigned Ser. No. 10/020,112. However, other active display units, besides that particularly described in the referenced patent application, may also be used as the active display unit 100, as can be appreciated by those of ordinary skill within the art.

The active display unit 100 includes a receptive element 102 and a light-controlling element 104, such as an emissive element. The receptive element 102 is receptive to a particular signal 106. The signal 106 may be provided to the receptive element 102 as a wired or wireless signal. For instance, the signal 106 may be an infrared (IR) signal having a particular range of frequencies, or a signal having a particular intensity. The receptive element 102 includes a turn-on threshold 108. If the signal 106 exceeds the turn-on threshold 108 of the receptive element 102, then the light-controlling element 104 displays a particular color 110 at a predetermined intensity. That is, the light-controlling element 104 in one embodiment is able to display the color 110 at a fixed intensity, or is able to not display the color 110 at all. In this embodiment, the element 104 is not able to, for instance, display the color 110 at a range of intensities. The color 110 may be white, red, green, blue, or another color.

Figure 2A:
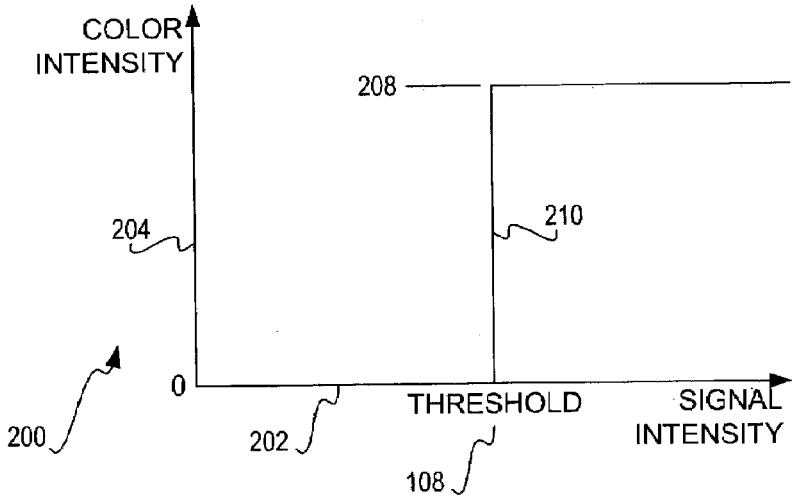
FIGS. 2A and 2B are graphs depicting performing of the active display unit of FIG. 1 in response to a signal, according to varying embodiments of the invention.
Figure 2B:
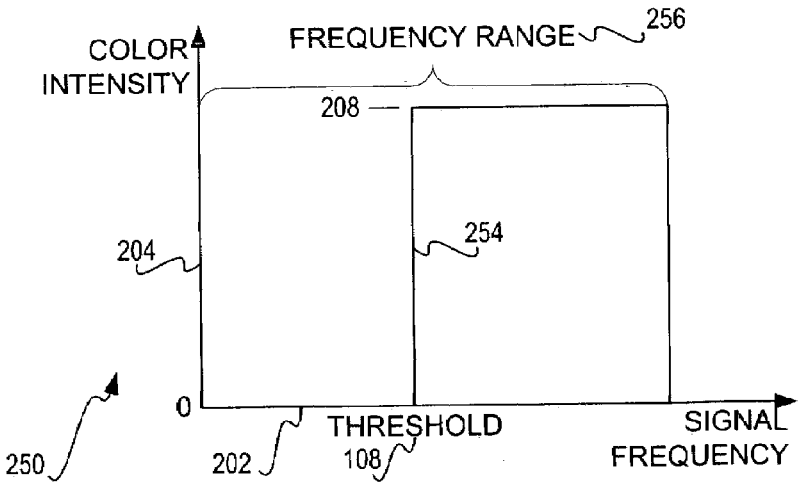

FIG. 2A shows a graph 200 depicting performance of the active display unit 100 where the threshold 108 is based on the intensity of the signal 106, whereas FIG. 2B shows a graph 250 depicting performance of the unit 100 where the threshold 108 is based on the frequency of the signal 106, according to varying embodiments of the invention. In FIG. 2A, the graph 200 plots the intensity of the color output by the element 104 of the active display unit 100 on the y-axis 204, as a function of the intensity of the signal 106 on the x-axis 202. The receptive element 102 of the unit 100 is responsive to the signal 106, such that the line 210 of the graph 200 is a step function. When the intensity of the signal 106 is below the threshold 108, the intensity of the color output by the light-controlling element 104 is zero, since the element 104 is turned off and does not output any color. When the intensity of the signal 106 is above the threshold 108, the intensity of the color output by the element 104 is at a fixed level denoted by the reference number 208, since the element 104 has turned on.

In FIG. 2B, the graph 250 plots the intensity of the color output by the light-controlling element 104 of the active display unit 100 on the y-axis 204, as a function of the frequency of the signal 106 on the x-axis 202. The receptive element 102 of the unit 100 is responsive to a range of frequencies 256 of the signal 106, such that the line 254 is a pulse function. When the frequency of the signal 106 is within the frequency range 256 but below the threshold 108, the intensity of the color output by the element 104 is zero, since the element 104 is turned off and does not output any color. When the frequency of the signal 106 is within the frequency range 256 but above the threshold 108, the intensity of the color output by the element 104 is at a fixed level denoted by the reference number 208, since the element 104 has turned on. However, when the frequency of the signal 106 is not within the frequency range 256, even if above the threshold 108, the intensity of the color output by the element 104 is zero, because the receptive element 102 is not responsive to frequencies outside the range 256.

Sub-Pixel Assemblies

Figure 3:
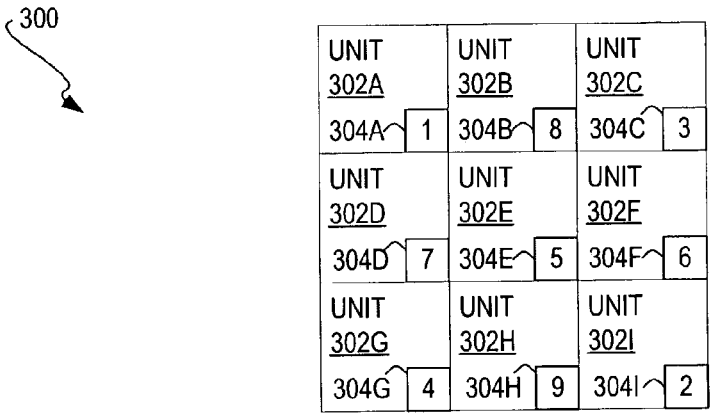
FIG. 3 is a diagram of a sub-pixel assembly, or group or sub-group, of active display units that are organized by their turn-on thresholds to achieve dithering, according to an embodiment of the invention.

FIG. 3 shows a sub-pixel assembly 300 having a number of active display units 302, according to an embodiment of the invention. The sub-pixel assembly 300 can also be referred to as a group, or a sub-group, of the active display units 302, in varying embodiments of the invention. The sub-pixel assembly 300 corresponds to a pixel to be displayed, where the active display units 302 are the sub-pixels of the assembly 300. The active-display units 302 specifically includes nine active display units 302A, 302B, 302C, 302D, 302E, 302F, 302G, 302H, and 302I organized in a three-by-three matrix in the embodiment depicted in FIG. 3. However, in other embodiments, there may be more or fewer than nine active display units 302. Each of the units 302 may be implemented as the active display unit 100 of FIG. 1, in one embodiment of the invention. The units 302 are preferably addressable as a group, and not individually, such that each of the units 302 of the assembly 300 is responsive to the same signal. The units 302 may specifically output the same color, such as white, red, green, or blue, or different of such colors.

At least some of the active display units 302 have different turn-on thresholds, and the active display units 302 are organized by their turn-on thresholds, to achieve dithering of the pixel to which the assembly 300 represents, without individually addressing each sub-pixel, or display unit. As depicted in the embodiment of FIG. 3, the units 302 have unique, normalized and relatively ordered turn-on thresholds 304, where a turn-on threshold of one represents a minimum turn-on threshold, and a turn-on threshold of nine represents a maximum turn-on threshold. The turn-on thresholds 304 of the units 302 specifically include the turn-on threshold 304A of one, the threshold 304B of eight, the threshold 304C of three, the threshold 304D of seven, the threshold 304E of five, the threshold 304F of six, the threshold 304G of four, the threshold 304H of nine, and the threshold 3041 of two. However, in other embodiments of the invention, the turn-on thresholds 302 may be ordered differently than depicted in FIG. 3, and some of the turn-on thresholds 302 may be equal to one another. The thresholds 304 of the units 302 are also preferably independent of one another.

Figure 4A:
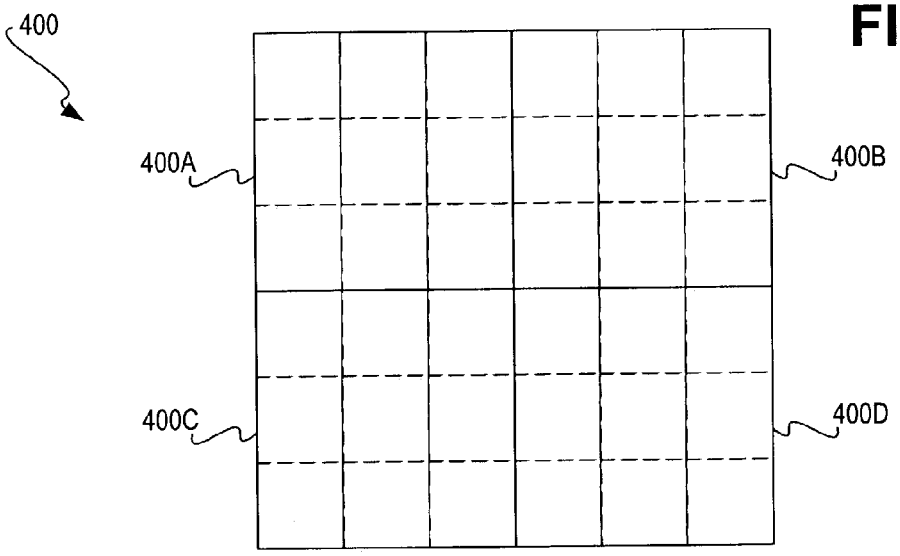
FIG. 4A is a diagram of a number of groups of active display units that output the same color, with the units of each group organized by their turn-on thresholds to achieve dithering, according to an embodiment of the invention.

FIG. 4A shows a group of sub-pixel assemblies 400, according to an embodiment of the invention. The sub-pixel assemblies 400 specifically include the assemblies 400A, 400B, 400C, and 400D. The assemblies 400 may each correspond to a different pixel, such that each of the assemblies 400 is considered a group of active display units. Alternatively, all of the assemblies 400 may correspond to a single pixel, such that the assemblies 400 together constitute a group of active display units, and each of the assemblies 400 is considered a sub-group of active display units. The assemblies 400 are demarcated from one another in FIG. 4A by solid lines, whereas the individual active display units of each of the assemblies 400, not specifically called out in FIG. 4A for illustrative clarity, are demarcated from one another by dotted lines. Each of the assemblies 400 is specifically implemented as the sub-pixel assembly 300 of the embodiment of FIG. 3. Furthermore, the active display units of each of the assemblies 400 preferably output the same color, such as white.

Figure 4B:
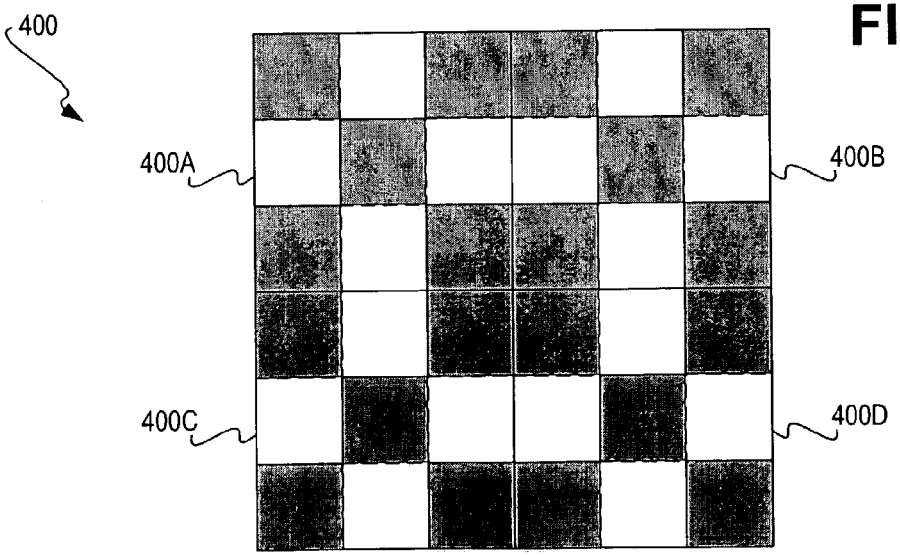
FIG. 4B is a diagram of the groups of active display units of FIG. 4A, in which by way of example the groups of units have responded to a signal of a particular intensity, according to an embodiment of the invention.

FIG. 4B shows an example in which the sub-pixel assemblies 400 are all responding to the same signal having an intensity of six, according to an embodiment of the invention. Active display units of the sub-pixel assemblies 400 that output color in response to being turned on by the signal are depicted in FIG. 4B by being shaded, whereas active display units of the assemblies 400 that do not output color, since they are not turned on, are depicted by being white. (It is noted that in the case where the color being output is white, this means that the shaded display units are those that output white, whereas the unshaded display units are those in which no white is being output, and thus are black.) Since each of the assemblies 400 is specifically implemented as the sub-pixel assembly 300 of the embodiment of FIG. 3, this means that the units 302A, 302C, 302E, 302G, and 302I of the assembly 300, as each of the assemblies of 400, is turned on and outputs color. This is because the intensity of the signal being six is greater than the turn-on thresholds 304A, 304C, 304E, 304G, and 304I of their respective units 302, and is not greater than the turn-on thresholds 304 of the other units 302.

The number of active display units of the sub-pixel assemblies 400 that turn on is thus based on the intensity level of the signal to which the units are responsive. When the intensity level of the signal is relatively low, fewer units of the assemblies 400 turn on, whereas when the intensity level of the signal is relatively high, more units of the assemblies 400 turn on. By organizing the active display units in each of the sub-pixel assemblies 400 in accordance with their turn-on thresholds, where different units have different thresholds, dithering is therefore achieved. That is, in the example of FIG. 4B, where each unit of each of the assemblies 400 is able to only display maximum color or no color, having units with different thresholds in each of the assemblies 400 nevertheless allows pixels to which the assemblies 400 corresponds that have varying shades of this color to be displayed. For example, for pixels having varying shades of gray, the assemblies 400 can simulate the shades of gray by having their active display units selectively turned on, due to their different turn-on thresholds, even though the units themselves may only be able to output white.

Figure 5A:
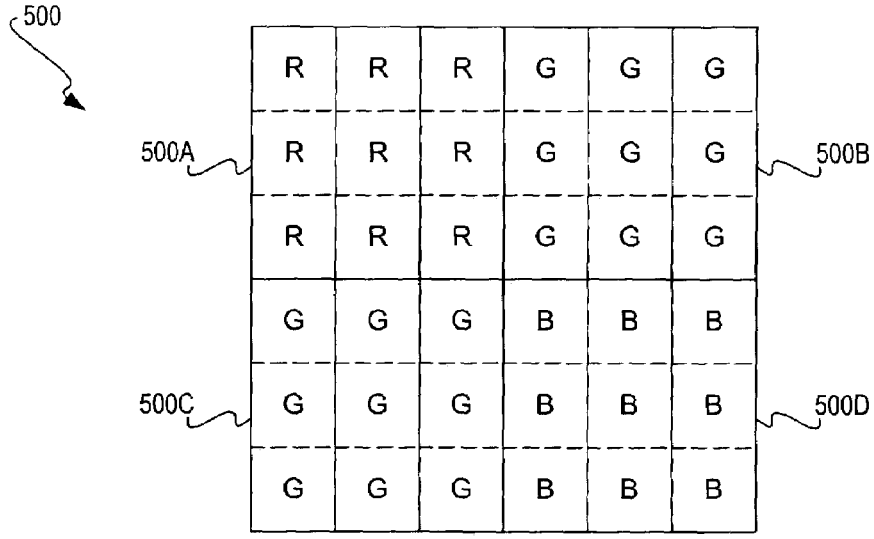
FIGS. 5A and 5B are diagrams of a number of groups of sub-groups of active display units, with the units of each sub-group outputting the same color and organized by their turn-on thresholds to achieve dithering, according to varying embodiments of the invention.
Figure 5B:
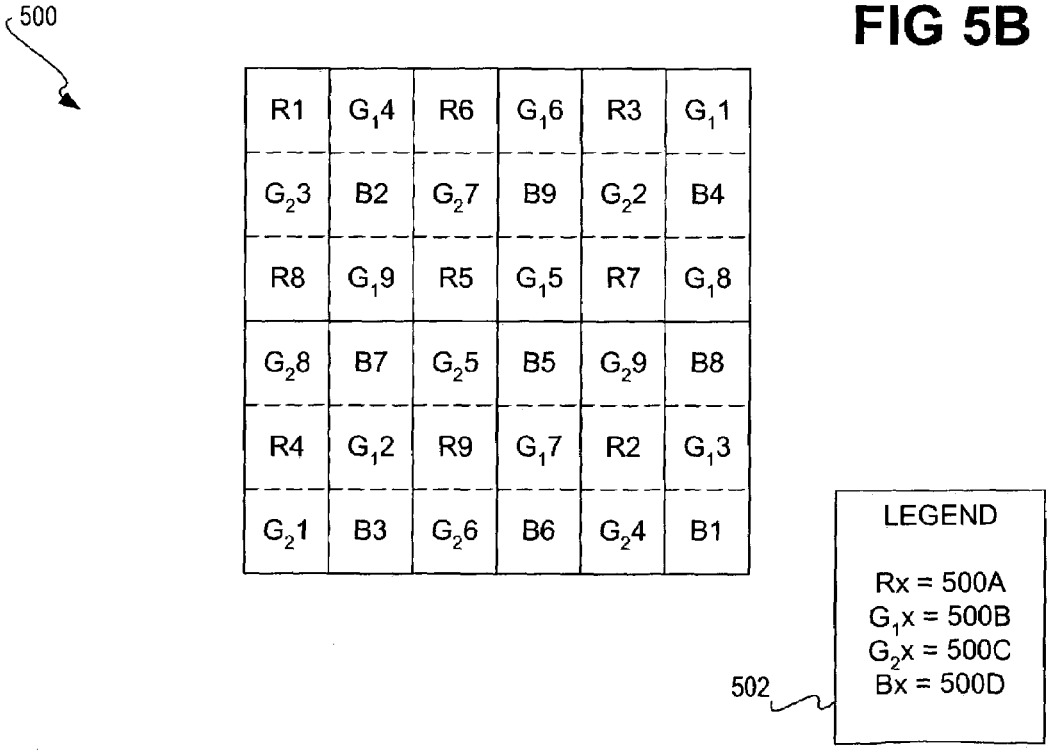

The embodiments of FIGS. 4A and 4B thus utilize a grouping of a number of the sub-pixel assembly 300 to specifically implement a monochromatic display, such as a black-and-white display in which different shades of gray are achievable. However, in other embodiments of the invention, a number of the sub-pixel assembly 300 can be grouped and/or sub-grouped to specifically implement a color display in which different intensities of different colors can be achieved. FIGS. 5A and 5B show a group of such sub-pixel assemblies 500 to display different intensities of different colors through dithering, according to varying embodiments of the invention.

In FIG. 5A, the group of sub-pixel assemblies 500 specifically includes the sub-pixel assemblies 500A, 500B, 500C, and 500D. Each of the sub-pixel assemblies 500 may be referred to as a sub-group of active display units, where the group of all the sub-pixel assemblies 500 may be referred to as a group of active display units. In another embodiment, each of the sub-pixel assemblies 500 is referred to as a group of active display units, such that the group of all the sub-pixel assemblies 500 includes four such groups of active display units. The group of sub-pixel assemblies 500 corresponds to a single pixel having constituent color components, such as a red color component, a green color component, and a blue color component. The assemblies 500 are demarcated from one another in FIG. 5A, whereas the individual active display units of each of the assemblies 500, not specifically called out in FIG. 5A for illustrative clarity, are demarcated from one another by dotted lines. The units of each of the assemblies 500 are contiguous to one another in the embodiment of FIG. 5A.

Each of the assemblies 500 is preferably specifically implemented as the sub-pixel assembly 300 of the embodiment of FIG. 3. However, the active display units of the assemblies 500 do not all output the same color. For instance, the active display units of the assembly, or sub-group, 500A output the color red, indicated by the letter "R" in each of the units, whereas the active display units of the assembly 500D, or sub-group, output the color blue, indicated by the letter "B" in each of the units. The active display units of the assemblies, or sub-groups, 500B and 500D output the color green, indicated by the letter "G" in each of the units. Thus, the active display units of the assembly 500A is responsive to a signal corresponding to the red color component of the pixel to which the assemblies 500 as a whole correspond, whereas the units of the assemblies 500B and 500C is responsive to a signal corresponding to the green color component of this pixel. Similarly, the active display units of the assembly 500D are responsive to a signal corresponding to this pixel's blue color component.

In one embodiment, the active display units of each of the assemblies 500 are responsive to a different signal compared to the active display units of other of the assemblies 500. For instance, the active display units of the assembly 500A may be addressable as a group and responsive to a signal having an intensity corresponding to the red color component of the pixel to which the assemblies 500 as a whole correspond. The units of the assemblies 500B and 500C may be addressable as a group and responsive to a signal having an intensity corresponding to the green color component of the pixel. The units of the assembly 500D may be addressable as a group and responsive to a signal having an intensity corresponding to the blue color component of the pixel.

In another embodiment, the active display units of the assemblies 500 are responsive to the same signal, where the signal has constituent components to which the units of each of the assemblies 500 are particularly responsive. For instance, the active display units of the assembly 500A may be addressable as a group and responsive to a frequency range of the signal in which a frequency corresponds to the red color component of the pixel to which the assemblies 500 as a whole correspond. The units of the assemblies 500B and 500C may be addressable as a group and responsive to another frequency range of the signal in which a frequency corresponds to the green color component of the pixel. The units of the assembly 500D may be addressable as a group and responsive to a third frequency range of the signal in which a frequency corresponds to the blue color component of the pixel.

Whereas in FIG. 5A the active display units of the sub-pixel assemblies 500 are contiguous to one another, in FIG. 5B, the active display units of the sub-pixel assemblies 500 are non-contiguous to one another. Otherwise, the embodiment of FIG. 5B is identical to that of FIG. 5A. A legend 502 indicates which active display units in FIG. 5B belong to which of the sub-pixel assemblies 500. An active display unit indicated as Rx, where x is a number between one and nine, belongs to the assembly 500A and displays the color red. A unit indicated as $G_1x$, where x is a number between one and nine, belongs to the assembly 500B, whereas a unit indicated as $G_2x$ belongs to the assembly 500C. The active display units of both the assemblies 500B and 500C output the color green. Finally, a unit indicated as Bx, where x is a number between one and nine, belongs to the assembly 500D and displays the color blue.

Display Device and Methods

Figure 6:
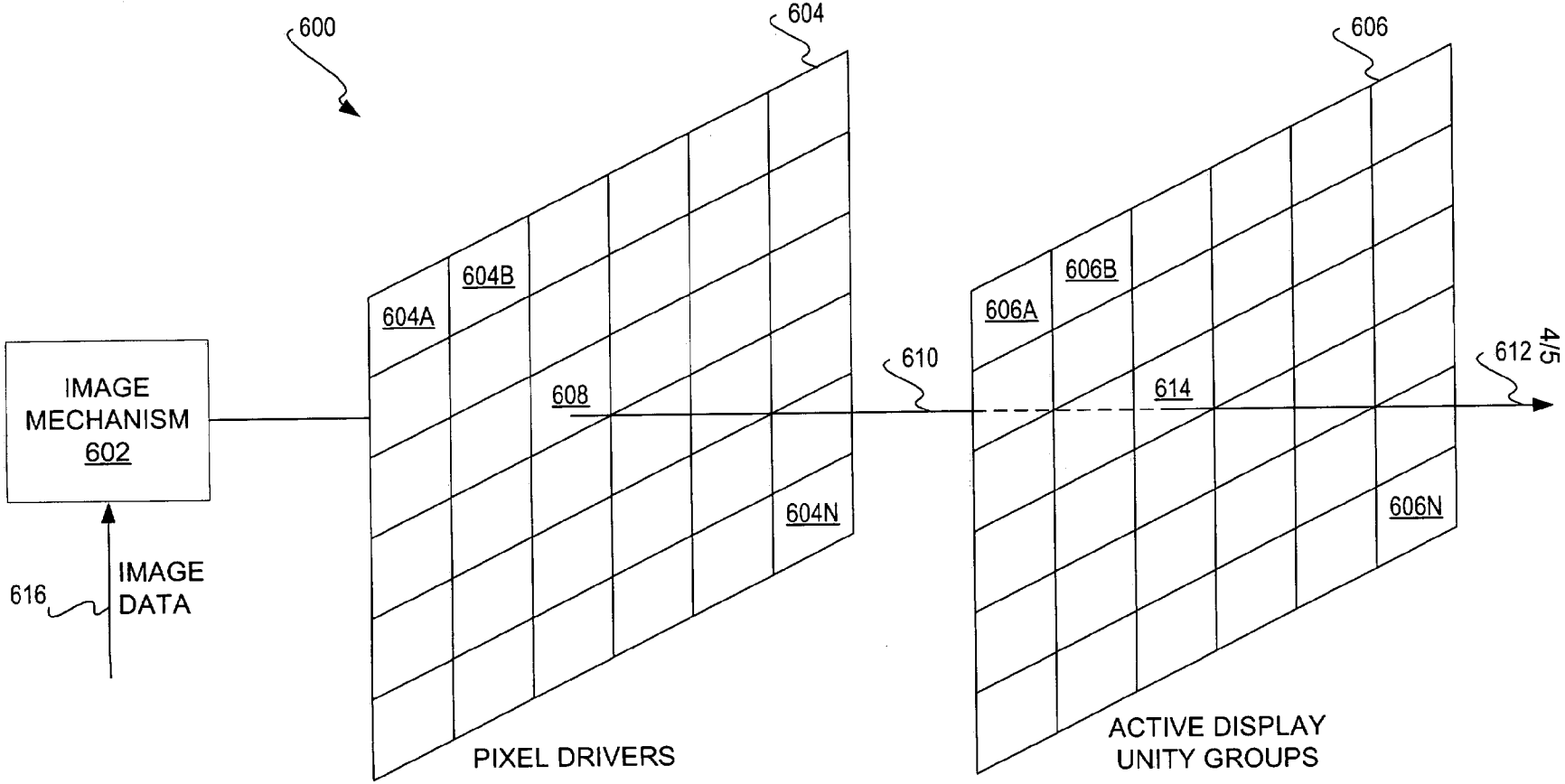
FIG. 6 is a diagram of a display device, according to an embodiment of the invention.

FIG. 6 shows a display device 600, according to an embodiment of the invention. The display device 600 is specifically depicted in FIG. 6 as a projector system, such as a digital or an analog projector system, a front-projection or a rear-projection projector system, and so on. However, in other embodiments of the invention, the display device 600 may be a different type of display device. For instance, the display device 600 may be a computer monitor, an active display billboard, an active-display poster or advertising, a roadside active display traffic-warning sign, and so on, as can be appreciated by those of ordinary skill within the art.

The display device 600 includes an image mechanism 602, pixel drivers 604, and active display unit groups 606. The display device 600 may also include other components, in addition or in lieu of those depicted in FIG. 6, as can be appreciated by those of ordinary skill within the art. The image mechanism 602 includes software, hardware, or a combination of software and hardware, that receives image data from an image source, as indicated by the arrow 616. The image mechanism 602 in turn may optionally scale the image data, if the image data does not have the same resolution as the pixel drivers 604. For each pixel of the image data, the image mechanism 602 communicates a value of the pixel to a corresponding one of the pixel drivers 604.

The pixel drivers 604 include the pixel drivers 604A, 604B, . . . , 604N, and specifically the pixel driver 608. The pixel drivers 604 may also be implemented as hardware and/or software. The pixel drivers 604, in response to the pixel values communicated thereto by the image mechanism 602, provide signals based on these pixel values to their corresponding active display unit groups 606. That is, each of the pixel drivers 604 individually communicates with one of the active display unit groups 606. The active display unit groups 606 include the active display unit groups 606A, 606B, . . . , 606N, and specifically the active display unit group 614.

In one embodiment of the invention, the active display unit groups 606 may each be implemented as the sub-pixel assembly 300 of FIG. 3, the group of sub-pixel assemblies 400 of FIGS. 4A and 4B, or the group of sub-pixel assemblies 500 of FIG. 5A or FIG. 5B. In response to the signals communicated to the groups 606, the active display units thereof display color based on whether their turn-on thresholds have been exceeded by the received signals. For illustrative clarity, only one of the signals provided by the pixel drivers 604 to the active display unit groups 606 is depicted in FIG. 6, the signal(s) 610 from the pixel driver 608 to the active display unit group 614. Likewise, only one of the colors displayed by the active display unit groups 614 is depicted in FIG. 6, the color(s) 612 output by the active display unit group 614.

Each of the pixel drivers 604 may send one or more signals to its corresponding one of the active display unit groups 606. For example, to implement a monochromatic display, where the active display units of each of the active display unit groups 606 outputs the same color and is responsive to the same signal, the corresponding one of the pixel drivers 604 may send one signal having an intensity corresponding to the values of its corresponding pixel. As another example, to implement a color display, where the units of each of the groups 606 are organized into sub-groups outputting different colors and responsive to different frequencies of the same signal, the corresponding one of the drivers 604 may send one signal having frequency components corresponding to the individual color component values of its corresponding pixel. Alternatively, to implement a color display where the units of each of the groups are organized into sub-groups responsive to different signals, the corresponding one of the drivers 604 may send different signals having intensities corresponding to the individual color component values of its corresponding pixel.

Figure 7:
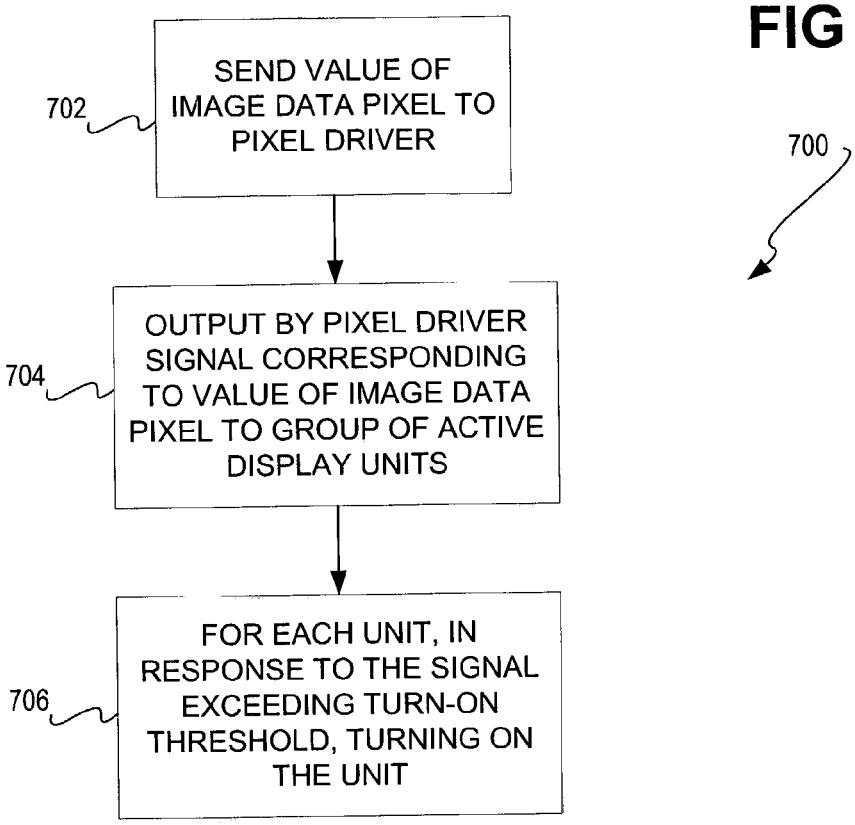
FIG. 7 is a flowchart of a method of use, according to an embodiment of the invention.

FIG. 7 shows a method of use 700, according to an embodiment of the invention. The method 700 can be performed by the display device 600 of FIG. 6. The method 700 may be implemented as a computer program stored on a computer-readable medium, such as a volatile or non-volatile medium, a fixed or removable medium, and a magnetic, optical, and/or solid-state medium. The method 700 is described in the context of a single pixel driver, such as one of the pixel drivers 604 of FIG. 6, and a single group of active display units, such as one of the groups 606.

The value of an image data pixel is sent to the pixel driver (702), such as by the image mechanism 602 of FIG. 6. The pixel driver outputs signal(s) corresponding to the value of the image data pixel to the group of active display units corresponding to this pixel (704). The signal may have an intensity corresponding to the value of the pixel, a frequency corresponding to the value of each color component of the pixel, and so on. For each active display unit, if the appropriate signal exceeds the turn-on threshold of the unit, then the unit is turned on (706). That is, the unit displays its predetermined color where the signal exceeds its turn-on threshold. The signal's intensity may exceed the threshold, the signal's frequency may exceed the threshold, and so on.

Figure 8:
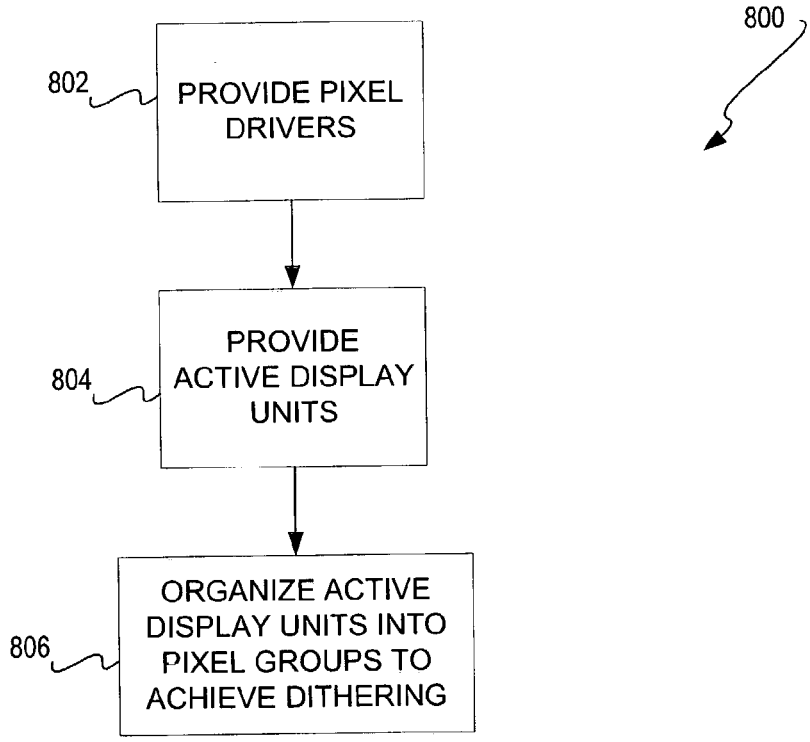
FIG. 8 is a flowchart of a method of manufacture, according to an embodiment of the invention.

FIG. 8 shows a method of manufacture 800, according to an embodiment of the invention. The method 800 can be performed to manufacture the display device 600 of FIG. 6. A number of pixel drivers are initially provided (802), as well as a number of active display units (804), which are organized into pixel groups to achieve dithering (806). The pixel drivers correspond to the pixel groups, and each pixel driver provides one or more signals corresponding to the value of an image data pixel to a corresponding pixel group.

Each group thus is receptive to the signals corresponding to the value of the image data pixel, and to which turn-on thresholds of the active display units of each group are responsive. The active display units may achieve a monochromatic display, where each unit displays the same color, and where preferably there are the same number of units with the same turn-on thresholds in each group. The active display units may also achieve a color display, where each unit displays one of a number of colors, and where preferably each group has the same number of units of each color and with the same turn-on thresholds.

CONCLUSION

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

We claim:

1. A sub-pixel assembly comprising:

a plurality of active display units, each active display unit capable of controlling light and having a turn-on threshold responsive to a signal, the plurality of active display units organized by the turn-on thresholds thereof to achieve dithering of the light in response to the signal, wherein the active display units are organized within a matrix of three-by-three active display units, and the turn-on thresholds of the active display units of the matrix, from an upper left-hand active display unit to a lower right-hand active display unit, are relatively ordered with respect to one another as 1, 8, 3, 7, 5, 9, 4, 6, and 2, where an ordering of 1 indicates a lowest turn-on threshold, and an ordering of 9 is a highest turn-on threshold.

2. The sub-pixel assembly of claim 1, wherein the plurality of active display units are group addressable.

3. The sub-pixel assembly of claim 1, wherein each active display unit comprises a receptive element receptive to the signal and a light-controlling element to control the light when the turn-on threshold has been exceeded by the signal.

4. The sub-pixel assembly of claim 1, wherein the turn-on threshold of each active display unit is unique relative to the turn-on thresholds of the other of the plurality of active display units.

5. The sub-pixel assembly of claim 1, wherein the turn-on threshold of each active display unit is responsive to an intensity of the signal.

6. The sub-pixel assembly of claim 1, wherein the turn-on threshold of each active display unit is responsive to a frequency within a range of frequencies of the signal.

* * * * *